US005152404A

United States Patent [19]

Salrin et al.

[11] Patent Number: 5,152,404

[45] Date of Patent: Oct. 6, 1992

[54] ANGLED FIXTURE AND DISPLAY ASSEMBLY

[75] Inventors: John P. Salrin, Dublin; James W. Bates, Port Washington, both of Ohio

[73] Assignee: Lancaster Colony Corporation, Columbus, Ohio

[21] Appl. No.: 681,998

[22] Filed: Apr. 8, 1991

[51] Int. Cl.[5] ..... A47F 7/16

[52] U.S. Cl. ..... 211/46; 211/94; 211/86; 248/215

[58] Field of Search ..... 211/46-48, 211/86, 94, 59.1, 94.1; 248/214, 215, 304, 307, 231.4

[56] References Cited

U.S. PATENT DOCUMENTS

| | | | |
|---|---|---|---|
| D. 155,705 | 10/1949 | Hobbs | 211/60.1 X |
| 1,139,605 | 5/1915 | Walker | 211/94 |
| 1,185,011 | 5/1916 | Sievert | 211/48 |
| 1,766,198 | 6/1930 | Rosenberg et al. | 248/214 |
| 1,927,659 | 9/1933 | Hamer . | |
| 2,023,866 | 12/1935 | Best | 211/48 |
| 2,033,430 | 3/1936 | Kirik | 40/617 X |
| 2,149,123 | 2/1939 | Nicolaus | 248/215 |
| 2,194,191 | 3/1940 | Wolf | 211/96 |
| 2,459,909 | 1/1949 | Alofs . | |
| 3,568,852 | 3/1971 | Howard . | |
| 3,777,896 | 12/1973 | Ehrlich . | |
| 3,814,263 | 6/1974 | Kinard . | |
| 4,449,686 | 5/1984 | Kersey . | |
| 4,516,681 | 5/1986 | Jahel . | |
| 4,520,978 | 6/1985 | Taub | 211/59.1 X |
| 4,779,743 | 10/1988 | McKinnon . | |
| 4,813,552 | 3/1989 | Walter . | |
| 4,869,376 | 9/1989 | Valiulis et al. | 211/59.1 |

FOREIGN PATENT DOCUMENTS

| | | | |
|---|---|---|---|
| 2133684 | 8/1984 | United Kingdom | 211/94.5 |

OTHER PUBLICATIONS

Catalog RubberQueen "The Leading Manufacturer of Automotive Floor Mats", pp. 24-25.

Kraco Advertising entitled "Car Mat Displays".

Car and Truck floor mat display plan "Nationwise Auto Parts Inc. 48" Plan-O-Gram".

Catalog "Plasticolor Car Mats, Truck Mats, Van Mats, Splash Guards, Mud Guards", pp. 29-31.

*Primary Examiner*—Carl D. Friedman

*Assistant Examiner*—Korie Hung Chan

*Attorney, Agent, or Firm*—Frost & Jacobs

[57] ABSTRACT

There is provided an angled display assembly having a plurality of product display fixtures attached to and spaced along a polygonal display standard. Each of the display fixtures includes an inverted, generally U-shaped mounting bracket designed to slidably clamp over the display standard, and a support arm extending outwardly from the mounting bracket and having proximal and distal portion. The distal portion of the support arm is attached in a bent configuration to the proximal portion so that, in clamped position, the distal portion extends outwardly from the standard at a predetermined, non-normal and non-parallel angle thereto. A support lock extends downwardly away from the mounting bracket and includes a locking leg spaced from the support arm which interacts with the bottom portion of the standard to lock the display fixture thereto and offset rotational moments imposed by supported products.

28 Claims, 2 Drawing Sheets

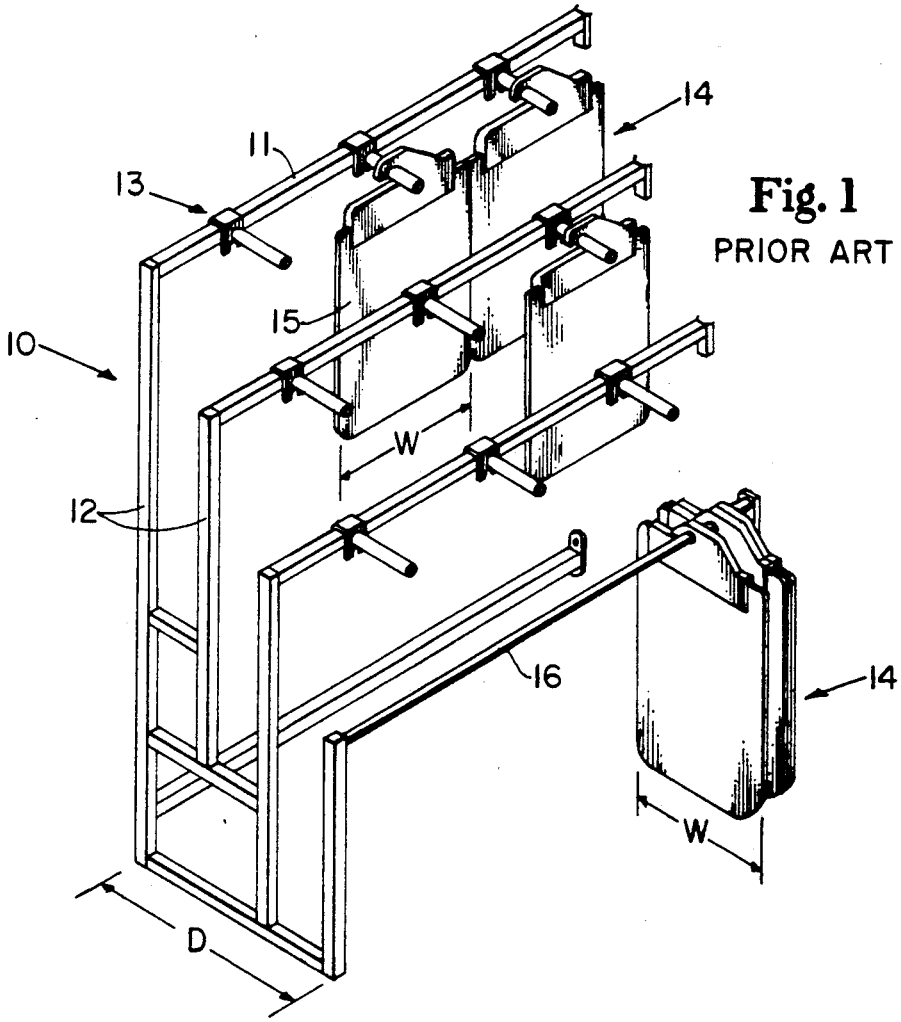
Fig. 1
PRIOR ART
Fig. 2
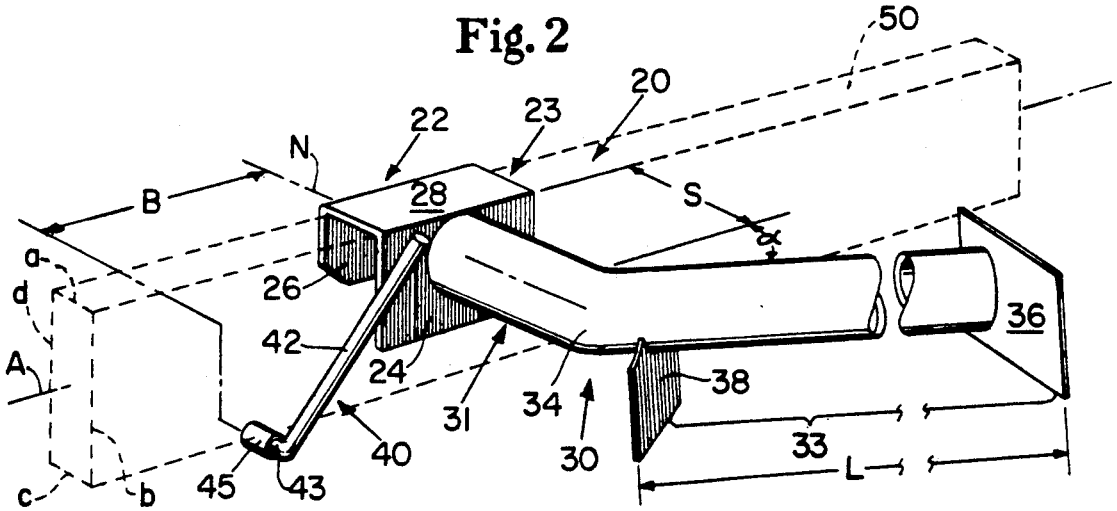

ANGLED FIXTURE AND DISPLAY ASSEMBLY

TECHNICAL FIELD

This invention relates to product display racks and the fixtures which make up those racks, and, more particularly, to an improved fixture and display assembly for relatively flat products, wherein individual fixtures are angled in a predetermined orientation to enable optimum display and convenient stocking, removal and replacement of the products.

BACKGROUND ART

This invention is directed toward overcoming disadvantages and shortcomings in prior art display devices and fixtures designed to support relatively planar products such as carpet samples, floor mats, sample books, posters, or the like in a space efficient manner which is conducive to optimum display of the products and access for stocking procedures as well as customer inspection.

For example, heretofore product display racks for items such as aftermarket retail automotive floor mats have generally included a series of horizontally disposed, vertically spaced, display rack supports upon which a plurality of projecting support rods were anchored. Respective rows of support rods were also spaced in a tiered, front to rear fashion, and a plurality of floor mats were hung on each outwardly extending rod in side-by-side relationship In this arrangement, however, only the floor mat hanging on the front of each support rod was visible to the customer, and the number of floor mats which could be hung on each support rod was limited by the front to rear spacing between respective rows. In order to save space, the lower portions of floor mats supported on the upper tiers of the display extended below and behind the upper portions of lower tiers of product. Consequently, the number of mats which could be displayed on any particular rack of this nature was limited by the space available between the respective tiers, the number of support rods on any particular tier was directly controlled by the respective width of the adjacent mats, and only the upper portions of the front-most product hanging on each support rod was visible to the customer from the front of the display. Moreover, access to the floor mats for stocking, removal for inspection, and replacement following inspection was quite cumbersome and inconvenient due to the overlapping, tiered nature of the displays.

U.S. Pat. No. 3,568,852 (which issued to F. Howard) discloses a rack support for sample books of carpet or the like comprising a carrier element for each sample book which assumes a predetermined angularity with regard to the support bar as a result of a projecting member located adjacent an opening in the carrier element. This projecting member contacts the support bar and maintains the desired angularity. However, this structure requires a support bar extending between a spaced apart pair of columns and which is sufficiently spaced from an adjacent wall surface or the like to enable the products to hang freely. Such arrangement would not easily be adaptable to the often limited space restrictions encountered in retail displays and merchandising applications. Additionally, the strength and rigidity of the display device would be difficult to insure, and convenient labeling and distinction of various products or product models is not provided.

Similarly, a clothes display stand shown in U.S. Pat. No. 4,813,552 (which issued to H. Walter) lacks sufficient structure for insuring a strong and rigid display fixture and assembly capable of optimally displaying a maximum number of products. The extension arms of the Walter clothes display stand are oriented at an angle relative to the wall elements and include grooves to receive the clothes hangers and orient the individual products parallel to the wall. Such orientation limits the number of products which can be placed on the supports, and limits the number of products which can be easily seen by potential customers.

U.S. Pat. No. 4,449,686 (which issued to M. Kersey) illustrates a mounting bracket having a plurality of projections for supporting hooks of a garment hanger This display fixture would suffer from many of the same deficiencies as the standard, multi-tiered display arrangement described above. Similarly, the collapsible hanger for peg board type display panels set forth in U.S. Pat. No. 4,516,681 (which issued to A. Jahel) offers very limited support strength, and appears to be directed toward applications wherein relatively small, light products are to be supported.

Consequently, heretofore there has not been available a fixture and display assembly structure which adequately optimizes the number of products which can be simultaneously displayed and viewed by potential customers, and which features convenient access to the product for facilitating stocking, examination, and replacement by store personnel and customers alike. Prior fixtures and display assemblies were unnecessarily limited by space and product dimension restrictions, which limited their applicability, complicated display erection, product stocking, visual and physical access to the displayed products, and compromised efficient use of retail merchandising space.

DISCLOSURE OF THE INVENTION

It is an object of this invention to obviate the above-described problems and shortcomings of the fixture and display assembly structures heretofore available in the industry.

It is another object of the present invention to provide a display fixture and assembly for supporting a plurality of relatively planar products, such as floor mats and the like, which optimizes the number of products which are visually and physically accessible from the front of the display, and which is compact, simple and convenient to assemble and utilize.

It is also an object of the present invention to provide an angled display fixture for use in a display assembly which includes a support arm having a portion which extends outwardly from a mounting bracket in a substantially normal direction, and a portion which is oriented at a predetermined angle relative to the display rack support standard for supporting product at a predetermined optimal display angle.

It is yet another object of the present invention to provide an improved display assembly incorporating a plurality of angled display fixtures which enable the maximum number of products to be displayed with optimal visual and physical access, and which occupy a minimum volume of merchandising area.

In accordance with one aspect of the present invention, there is provided an angled display assembly having a plurality of product display fixtures attached to and spaced along a polygonal display standard. Each of the display fixtures includes an inverted, U-shaped mounting bracket having a corresponding size and shape to slidably clamp over the display standard, and a support arm extending outwardly from the mounting bracket and having proximal and distal portions or ends. The distal end of the support arm is attached in a bent configuration to the proximal end, extending outwardly from the standard at a predetermined, non-normal and non-parallel angle thereto. A support lock rigidly fixed to the mounting bracket and extending downwardly therefrom, includes a locking leg spaced from the support arm which interacts with the bottom portion of the standard to lock the display fixture in place, and to offset rotational moments imposed by products supported on the distal end of the support arm.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

FIG. 1 is a partial perspective view of a prior art display rack illustrating features commonly available in the merchandising industry;

FIG. 2 is a partial perspective view of a preferred rack fixture made in accordance with the present invention, illustrated with a display rack standard shown in phantom;

DETAILED DESCRIPTION OF THE INVENTION

Figure 3:
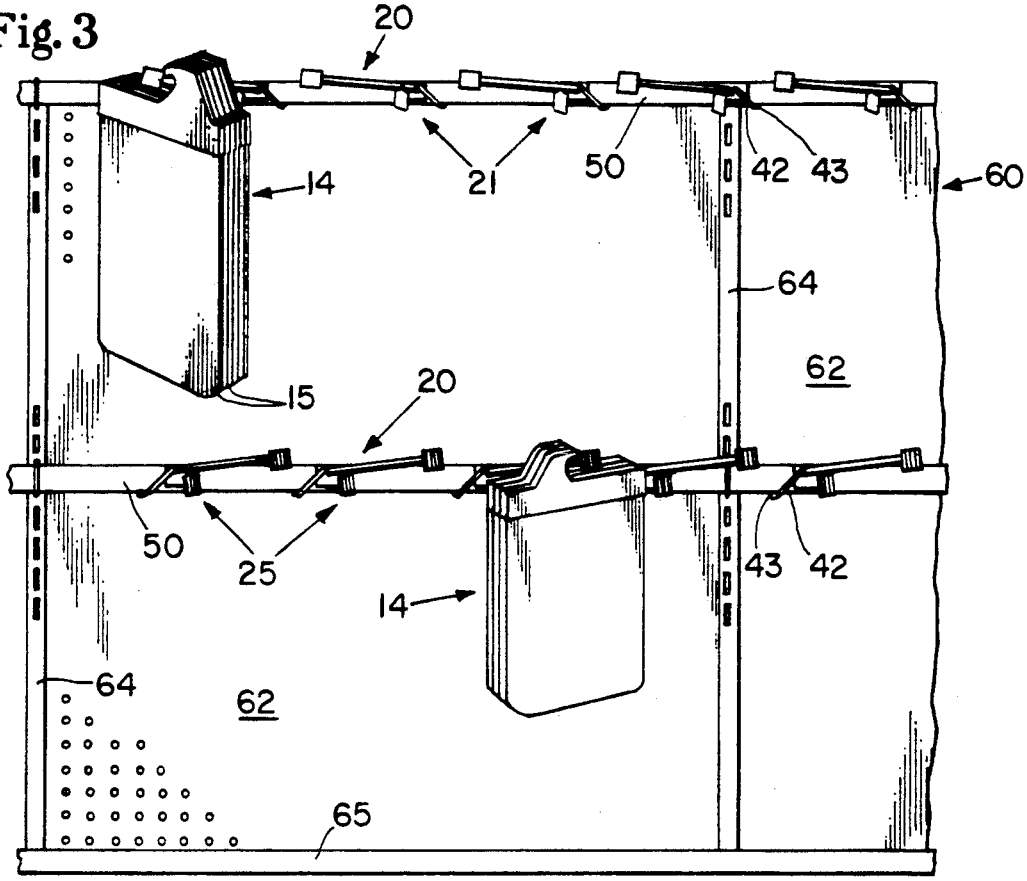
FIG. 3 is a partial front elevational view of an angled display rack assembly made in accordance with the present invention.

Referring now to the drawings in detail, wherein like numerals indicate the same elements throughout the views, FIG. 1 illustrates a prior art display rack 10 showing structures and features relatively common in the display industry. Particularly, display rack 10 includes a plurality of horizontal display standards 11, supported in tiered, spaced relationship by a plurality of vertical columns 12. Mounted on standards 11 are a plurality of outwardly extending product fixtures 13 for supporting relatively planar products 14, such as automotive floor mats or the like. A dowel rod 16 is also shown to illustrate another common structure for hanging a plurality of flat or planar products 14.

As described above, a tiered display rack, such as illustrated in FIG. 1, can accommodate only a limited number of product pieces as a result of its structural limitations. Particularly, the number of products (e.g., floor mats 14) that can be displayed is limited by the space available between adjacent tiers of standards 11, by the number of products which can be hung on any particular fixture 13, and by the number of products which can be placed side by side (i.e., limited by the width W of the individual products 14) within each tier.

Additionally, FIG. 1 demonstrates how only the top portions of the forward-most product 14 hanging on each fixture 13 can be seen from the front of the display. Often, due to the restricted space for retail displays, and adjacent display fixtures, visual and physical access to the displayed products from the ends or sides of the display is not possible. Consequently, only a very limited number of products can be seen by a customer, and the overall impact of the display is adversely affected. Distinguishing features of various models of products, and the full variety of colors and sizes available, is not easily displayed or seen in such display rack arrangements.

In addition to these shortcomings, display rack 10 requires substantial display space volume, including a predetermined depth D, as illustrated. Such volume requirements and dimensional criticalities further limit the applications in which such racks can be advantageously utilized. Moreover, as can be appreciated, stocking procedures and removal/replacement of products in the various tiers requires inconvenient reaching, and are complicated by interference between products 14 and closely adjacent products and display structure. For example, placement of product 14 on one of the fixtures 13 in the most upper tier requires directing the bottom portion (e.g., 15) of a product 14 into the space in addition to aligning a hanger structure with fixture 13. Such inconvenience often discourages customers from fully appreciating the differences in style, size, color, etc. of various products in the display, and from properly replacing removed products after examination.

Figure 4:
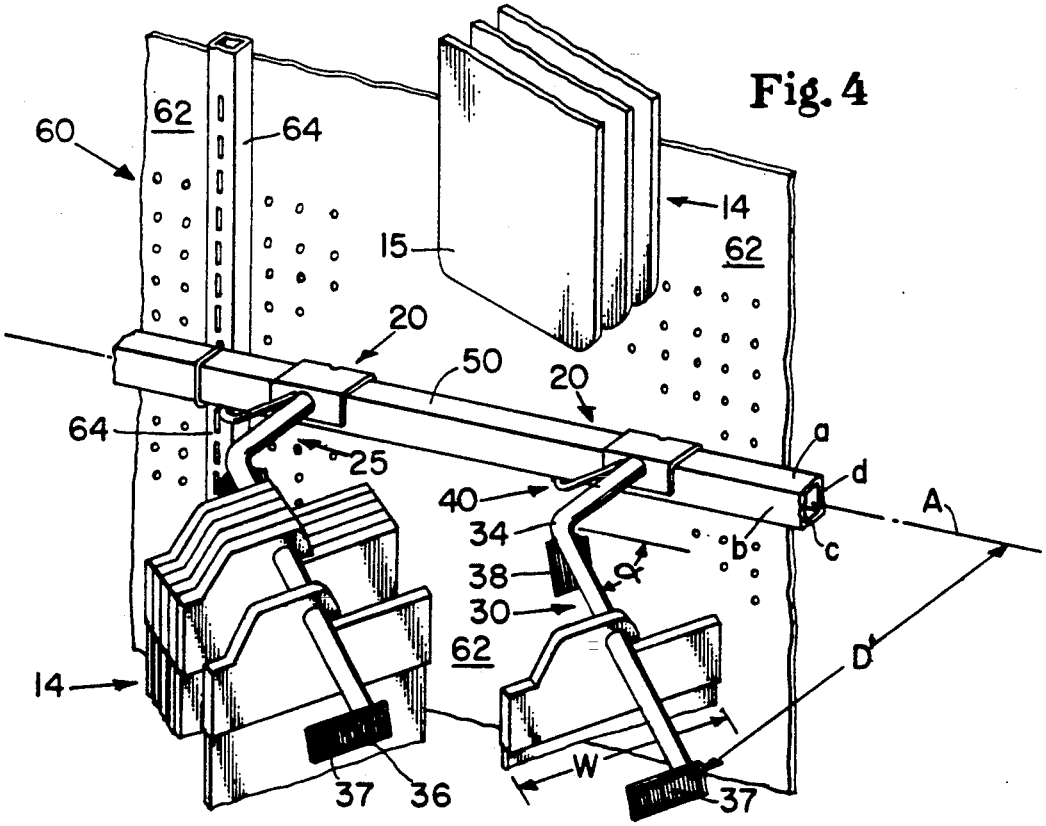
FIG. 4 is an enlarged, partial perspective view of the display rack assembly of FIG. 3.

To overcome these problems, an angular display fixture 20 has been developed for use in an optimum angled display assembly 60, as illustrated in FIGS. 2–4 Turning first to FIG. 2, display fixture 20 is illustrated as including a mounting bracket 22 preferably comprising a U-shaped member 23 having a front surface 24, a rear surface 26, and a top surface 28. As will be understood, mounting bracket 22 is designed to correspond to and slidably clamp over the top portions of a display standard (e.g., 50). While standard 50 may be provided in a variety of configurations, a polygonal shape is preferred to provide for stable mounting of a plurality of fixtures 20. Particularly, standard 50 is illustrated in phantom in FIG. 2 as a generally rectangular bar, as commonly used in a variety of support and display structures. Front, rear, and top surfaces (e.g., 24, 26, and 28) of U-shaped member 23 correspond to and closely match the shape and size of the upper portions of standard 50 in order to facilitate slidable clamping of mounting bracket 22 thereover.

A product support arm 30 extends outwardly from mounting bracket 22, and includes proximal portion or end 31 and distal portion or end 33. Proximal end 31 extends outwardly from front surface 24 along an axis N, which is preferably substantially perpendicular to the longitudinal axis A passing through the center of mounting bracket 22. Longitudinal axis A is also substantially coincident with the central longitudinal axis along the length of a display standard 50, onto which fixture 20 will be clamped. Distal end 33 of support arm 30 is attached to proximal end 31 at an interface area 34 in a bent configuration.

As best seen in FIG. 2, distal end 33 is preferably oriented at an angle $\alpha$ relative to longitudinal axis A, wherein the angle $\alpha$ is chosen to insure that distal end 33 will be oriented in a predetermined non-normal and non-parallel relationship to longitudinal axis A. FIG. 2 illustrates a "right-handed" fixture 20, wherein distal end 33 is bent to the right of its mounting bracket 22 (when viewing from the front of fixture 20). FIG. 3 illustrates both right-handed fixtures 25 and left-handed fixtures 21, as an example of a display arrangement 60 which can be provided with the subject fixtures.

Proximal portion 31 serves as a standoff for distal end 33, effectively spacing the angled portion of display fixture 20 at a predetermined spacing distance S from mounting bracket 22 and display standard 50. Spacing S can be varied, as can angle $\alpha$ to accommodate products of varying sizes and display requirements. As shown in FIGS. 3 and 4, substantially planar products (e.g., floor mats or the like) 14 are supported along the distal portion 33 of support arm 30 to provide enhanced visual and physical access to all of the products being displayed. Due to the angled orientation of products supported by fixtures 20 and 25, and due to the spacing S from standard 50, the width W of products 14 is no longer a limiting factor as to the number and spacing of products 14 which can be accommodated in a single angled display assembly 60. Moreover, as seen best in FIG. 4, portions of each of the products 14 displayed on any particular fixture 20 can be easily seen and are accessible for easy inspection and replacement from the front of the assembly 60.

At the outermost end of distal portion or end 33 is face plate 36, which extends laterally outwardly from distal end 33 to provide an effective retainer for products hung thereon. Additionally, face plate 36 can double as a convenient structure for interchangeable product identification, pricing, model indicia, or the like. Such identification (e.g., tag 37) facilitates use and maintenance of the assembly by retail employees and customers alike.

Adjacent interface area 34, a product stop 38 is preferably provided to prevent movement or migration of products 14 hung on arm 30 onto proximal end 31. It is also preferred that distal end 33 of arm 30 will be slightly upwardly inclined from interface area 34 to face plate 36, in clamped position. Such inclination prevents supported products from tending to slide toward face plate 36, and also accommodates possible, downward flexing which may result from heavy product loading. Stop 38 also helps to maintain products 14 in their preferred angular orientation for optimum visual and physical access, and maintains proper spacing of product and alignment relative to the display backwall 62.

Extending downwardly from U-shaped member 23 is a support lock 40, including a transverse member or arm 42 and a rearwardly directed locking leg 43. Transverse arm 42 is connected to mounting bracket 22, such as by welding, and extends downwardly and away from support arm 30. Locking leg 43 is attached adjacent the distal end of transverse arm 42, and is shown as comprising a rod-like finger extending rearwardly to fit below standard 50 in locking relationship. The distal end of locking leg 43 is also preferably provided with a protective cap 45, made of plastic, rubber, or the like, to prevent scuffing or scratching of interacting surfaces, and for safety during handling and assembly procedures.

Support lock 40 depends downwardly in a direction opposite to the outwardly extending direction of distal portion 33 of support arm 30. As illustrated in FIG. 3, lock 40 will be oriented downwardly and to the right in the "left-handed" fixtures 21, while oriented to the left in "right-handed" fixtures 25. In this way, locking leg 43 is laterally offset a predetermined distance B from the center of mounting bracket 22 and proximal portion 31 (e.g., axis N) of support arm 30, and underlies the bottom face "c" of standard 50 in use (see FIG. 2).

It is contemplated that in use, U-shape member 23 will be slidably clamped over the upper portions (e.g., faces a, b, and d) of standard 50, and then rotated until locking leg 43 underlies and contacts lower face "c". In this way, support lock 40 obviates accidental removal of fixture 20 once placed on standard 50, and offsets and counteracts any rotational moment imposed on mounting bracket 22 by the cantilevered nature of support arm 30.

Support lock 40 further enables relatively heavy loading of fixture 20 with products 14 in a safe and secure manner, without requiring more permanent attachment of fixture 20 to standard 50, such as by bolts, screws, welding or the like. While fixed attachment of the fixture to standard 50 may be desired in some cases, support lock 40 obviates such requirement and enables angled display fixture 20 to be slidable relative support 50 along axis A, thereby facilitating assembly, maintenance, or modification of a display assembly made in accordance herewith.

FIGS. 3 and 4 further illustrate the advantages of fixture and display assembly 60 of the present invention, wherein a plurality of angled fixtures (e.g. 20 and 25) can be mounted relatively closely adjacent to one another, with each supporting a plurality of products 14. Angled display assembly 60 is illustrated in FIG. 3 as including a plurality of vertically spaced standards 50 mounted relative to horizontally spaced display columns 64, such as along a wall of peg board 62 commonly used in retail . environments. A plurality of left-handed fixtures 21 are shown as being clamped along the upper tier of supports 50, whereby products 14 are supported to face generally toward the left of the display. On the lower tier of supports 50, a plurality of right-handed fixtures 25 are clamped to display a plurality of products 14 oriented to face generally toward the right of the display.

FIG. 4 illustrates a slightly enlarged partial perspective view of the lower portion of display assembly 60 of FIG. 3, emphasizing the accommodation of products 14 in a manner which enables optimum physical and visual access from the front of the display for both stocking and customer inspection. Due to the angular nature of fixtures 20, more products 14 can be hung from each fixture while minimizing the outwardly extending dimension D' required, as best seen in FIG. 4.

An angle $\alpha$ of approximately 45° has been found to be particularly advantageous in providing an optimum display fixture for automotive car mats and similar products. This angle could, of course, be adjusted to best suit particular display applications and product dimensions. Improved display of each of the individual products 14 is provided, and visual and physical access to all of the products is enhanced, while minimizing the structure required for the display assembly as well as the total volume of merchandising space required. Because of the improved use of space and the enhanced number of products 14 which can be simultaneously displayed and made easily accessible, the tiers of standard 50 can be vertically spaced so that the lower ends 15 of products 14 need not be placed behind other products being displayed. This further simplifies access to the products, as all products will be displayed adjacent a single plane (e.g., back wall 62), and each product will be easily removed and/or replaced on a particular fixture 20 without interference from surrounding display structure.

Having shown and described the preferred embodiments of the present invention, further adaptions of the angled display fixture and display assembly shown and described herein can be accomplished by appropriate modifications by one of ordinary skill in the art without departing from the scope of the present invention. Several of such potential modifications have been mentioned, and others will be apparent to those skilled in the art. For example, a display assembly 60 could have a plurality of vertically spaced standards wherein fixtures 20 mounted on each particular standard 50 would all have their respective face plates (e.g., 36) oriented in a common direction relative to longitudinal axis A. Successive tiers ay be oriented in the same direction, or in opposite directions. FIG. 3 illustrates an example where successive tiers are oriented in such opposite directions. Similarly, portions of a single tier could be segmented so as to be oriented in a particular direction (e.g., oriented to the left on the left side of the display, and oriented to the right on the right side).

Accordingly, the scope of the present invention should be considered in terms of the following claims and is understood not to be limited to the details of structure and operation shown and described in the application and drawings.

We claim:

1. An angled display fixture for supporting a plurality of relatively planar products in a display rack having a standard with a longitudinal axis along which one or more display fixture is to be located, said fixture comprising:

a mounting bracket for removably and slidably attaching said fixture along a standard of a display rack and having a longitudinal axis substantially parallel with said longitudinal axis of said standard in use;

a product support arm extending outwardly from said mounting bracket and having proximal and distal portions, said proximal portion attached to said mounting bracket and extending outwardly therefrom, and said distal portion being attached to said proximal portion at an interface area and oriented in a non-linear angled relationship therewith, said distal portion being spaced from said display rack by said proximal portion in use and extending substantially horizontally outwardly therefrom at a fixed acute angle relative to the longitudinal axis of said mounting bracket, whereby optimum physical and visual access to products hung from said distal portion is provided from the front of said display rack; and means on said support arm adjacent said interface area for preventing product supported on said distal portion of said fixture form moving onto said proximal portion.

2. The display fixture of claim 1, wherein said mounting bracket comprises a generally U-shaped, and wherein said display rack includes a polygonal display standard having a longitudinal axis, said U-shaped member having a plurality of surfaces corresponding to and arranged for slidable clamping over the top of said standard in use.

3. The display fixture of claim 2, further comprising a support lock rigidly fixed to one of said surfaces of said mounting bracket and extending downwardly therefrom, said support lock including a locking leg which underlies the bottom portion of said polygonal standard in use to lock said mounting bracket against rotational movement.

4. The display fixture of claim 1, wherein said support arm further comprises a face plate located on said distal portion, said face plate extending radially outwardly from said support arm and comprising a relatively flat surface.

5. The display fixture of claim 3, wherein said locking leg is laterally offset from said support arm along said longitudinal axes of said mounting bracket, whereby the locking leg lockingly interacts with said standard.

6. The display fixture of claim 1, wherein said means for preventing movement of product comprises a product stop which extends outwardly from said support arm.

7. The angled display fixture of claim 1, wherein said product support arm is formed integrally from a single piece in bent configuration.

8. An angled display fixture for display racks having a polygonal display standard with a longitudinal axis and top and bottom portions and along which one or more display fixture is to be located, said fixture comprising:

an inverted, generally U-shaped mounting bracket, said bracket including a plurality of surfaces corresponding to and arranged for slidable clamping over the top portions of said standard;

a support arm having proximal and distal portions and being attached to and extending outwardly from said mounting bracket such that when in clamped position, said distal portion extends substantially horizontally outwardly from said standard at a predetermined fixed acute angle relative to said longitudinal axis whereby said products are hung from said distal end with their planar dimension oriented substantially normal thereto; and a support lock rigidly fixed to one of said surfaces of said mounting bracket and extending downwardly therefrom, said support lock having a locking leg spaced along said longitudinal axis from said support arm for locking interaction with the bottom portion of said standard.

9. The angled display fixture of claim 8, wherein said support lock comprises a rod-like finger extending downwardly and rearwardly from said mounting bracket in a direction along the longitudinal axis of said mounting bracket generally away from said distal portion of said support arm.

10. The angled display fixture of claim 8, wherein said polygonal display standard is rectangular in conformation, and said U-shaped mounting bracket includes oppositely disposed front and rear faces joined at their upper portions by a top face and which correspond in shape and size to slidably fit over the top portions of the rectangular standard.

11. The angled display fixture of claim 10, wherein said support lock is attached to said front face and extends generally downwardly and longitudinally away from said support arm, and said locking leg extends rearwardly to interact with the bottom portion of said standard to lock said mounting bracket in place.

12. The angled display fixture of claim 8, wherein said distal portion of the support arm is angularly oriented in a predetermined direction relative to said longitudinal axis to correspond with similar angled display fixtures mounted adjacent thereto.

13. The angled display fixture of claim 8, wherein said product support arm is formed integrally from a single piece in bent configuration.

14. An angled display assembly having a plurality of product display fixtures selectively attached to and spaced along a polygonal display standard, said display standard having a longitudinal axis and top and bottom portions, said fixtures each comprising:

an inverted, generally U-shaped mounting bracket, said bracket including a plurality of surfaces corresponding to and sized for slidable clamping over the top portions of said standard;

a support arm extending outwardly from said mounting bracket and having proximal and distal portions, said distal portion attached to said proximal portion and extending outwardly therefrom, whereby, when in clamped position, said distal portion extends substantially horizontally outwardly from said standard at a predetermined fixed acute angle relative to said longitudinal axis; and a support lock rigidly fixed to said mounting bracket and extending downwardly therefrom, said support lock having a locking leg spaced from said support arm along said longitudinal axis for locking interaction with said standard.

15. The angled display assembly of claim 14, wherein said proximal portion of said support arm extends substantially horizontally outwardly from said mounting bracket in a direction generally normal to said longitudinal axis.

16. The angled display assembly of claim 15, wherein said distal portion of said support arm comprises a face plate adjacent its outermost portions, said face plate being effectively spaced in a first direction along said longitudinal axis from said mounting bracket by said angularly oriented distal portion.

17. The angular display assembly of claim 16, wherein a plurality of fixtures are clamped over a standard in spaced adjacent relationship, with their respective face plates oriented in a common direction along said longitudinal axis, whereby adjacent proximal portions of the respective fixtures provide angled hanging support for a plurality of substantially flat products to be displayed.

18. The angular display assembly of claim 17, further comprising a plurality of vertically spaced polygonal standards, and wherein fixtures mounted on each particular standard all have their respective face plates oriented in a common direction along said longitudinal axis.

19. The angular display assembly of claim 18, wherein fixtures mounted on at least one of said standards have their respective face plates oriented in a common first direction, while fixtures mounted on at least one of the other standards have their respective face plates oriented in a common direction opposite to said first direction along said longitudinal axis.

20. The angular display assembly of claim 14, wherein fixtures each comprise a product stop located on said support arm adjacent said interface area, said product stop extending outwardly from said support arm and effectively partitioning products hong on said distal end of said fixture from said proximal portion.

21. The angled display fixture of claim 14, wherein said support lock is attached to one of said surfaces of said mounting bracket and extends generally downwardly and longitudinally away from said mounting bracket, and said locking leg extends rearwardly to interact with the bottom portion of said standard to lock said mounting bracket in place.

22. The angled display fixture of claim 14, wherein said support lock comprises a transverse member which extends downwardly from said mounting bracket in a first direction along said longitudinal axis, said locking leg being connected to said transverse member, and wherein said distal portion of the support arm extends outwardly in a direction along said longitudinal axis opposite to said first direction.

23. The angled display fixture of claim 14, wherein said product support arm is formed integrally from a single piece in bent configuration.

24. An angled display fixture for supporting a plurality of relatively planar products in a display rack having a standard wit a top and bottom portion and a longitudinal axis along which one or more display fixture is to be located, said fixture comprising:

a mounting bracket for removably and slidably attaching said fixture along the top portion of a standard of a display rack;

a product support arm extending outwardly from said mounting bracket and having proximal and distal portions, said proximal portion attached to said mounting bracket and extending outwardly therefrom, and said distal portion being attached to said proximal portion at an interface area and oriented in a non-linear angled relationship therewith, said distal portion being spaced from said display rack by said proximal portion in use and extending substantially horizontally outwardly therefrom at a fixed acute angle relative to the longitudinal axis of said mounting bracket, whereby optimum physical and visual access to products hung from said distal portion is provided from the front of said display rack; and a support lock attached to said fixture and underlying the bottom portion of said standard in use.

25. The angled display fixture of claim 24, wherein said support lock is attached to said mounting bracket.

26. The angled display fixture of claim 24, wherein said support lock is integrally formed with said mounting bracket.

27. The angled display fixture of claim 24, wherein said support lock comprises a locking leg which underlies the bottom portion of said standard in use to prevent rotational movement of said mounting bracket.

28. The angled display fixture of claim 24, wherein said support lock comprises a transverse member attached to said mounting bracket, and a locking leg which extends below the standard in use.

* * * * *